US006276993B1

(12) United States Patent
Miller

(10) Patent No.: US 6,276,993 B1
(45) Date of Patent: Aug. 21, 2001

(54) FLUID ABRASIVE JETS FOR MACHINING

(76) Inventor: Donald Stuart Miller, Brookside, Church Walk, Harrold, Bedford MK 43 7DG (GB)

( * ) Notice: Subject to any disclaimer, the term of this patent is extended or adjusted under 35 U.S.C. 154(b) by 0 days.

(21) Appl. No.: 09/308,301

(22) PCT Filed: Sep. 1, 1998

(86) PCT No.: PCT/GB98/02627

§ 371 Date: Sep. 2, 1999

§ 102(e) Date: Sep. 2, 1999

(87) PCT Pub. No.: WO99/14015

PCT Pub. Date: Mar. 25, 1999

(30) Foreign Application Priority Data

Sep. 16, 1997 (GB) ..... 9719550

(51) Int. Cl.[7] ..... B24B 1/00

(52) U.S. Cl. ..... 451/40; 451/36; 451/38; 451/89; 451/90; 451/91; 451/97; 451/101

(58) Field of Search ..... 451/36, 38, 40, 451/89, 90, 91, 99, 101

(56) References Cited

U.S. PATENT DOCUMENTS

| | | | | |
|---|---|---|---|---|
| 3,811,795 | | 5/1974 | Olsen . | |
| 4,709,515 | * | 12/1987 | Copeland et al. | 451/99 |
| 4,723,387 | | 2/1988 | Krasnoff . | |
| 4,854,090 | | 8/1989 | Heron et al. . | |
| 5,107,630 | * | 4/1992 | Lodewijk | 451/101 |
| 5,195,280 | * | 3/1993 | Nicholson et al. | 451/99 |
| 5,283,991 | * | 2/1994 | Keizers | 451/101 |
| 5,312,040 | | 5/1994 | Woodward . | |

FOREIGN PATENT DOCUMENTS

| | | |
|---|---|---|
| 39 39 420 A 1 | 7/1992 | (DE) . |
| 0 391 500 A 2 | 10/1990 | (EP) . |
| WO 90/15694 | 12/1990 | (WO) . |
| WO 91/01852 | 2/1991 | (WO) . |
| WO 95/29792 | 11/1995 | (WO) . |

* cited by examiner

*Primary Examiner*—David A. Scherbel
*Assistant Examiner*—Shantese McDonald
(74) *Attorney, Agent, or Firm*—Heslin & Rothenberg, P.C.

(57) ABSTRACT

The apparatus comprises a storage vessel (19) for abrasive particles, a source of pressurised carrier fluid and a first conduit (11) to convey at least a major proportion of the incoming carrier fluid to a nozzle (16). A second conduit (9) connects the source of carrier fluid to an inlet of the storage vessel (19) and a third conduit (18) connects its outlet to the nozzle (16). A switching device (6) is selectively operable either to allow a minor proportion of incoming carrier fluid to flow through the second conduit (9) to the storage vessel (19), or to direct all of the carrier fluid through the first conduit (11). When a minor proportion of carrier fluid is directed through the second conduit (9), abrasive particles in carrier fluid are discharged from storage vessel (19) into the third conduit (18). When all of the carrier fluid is directed through the first conduit (11), fluid from the second conduit is entrained, thereby reversing fluid flow in the second (9) and third (18) conduits. The source of pressurised carrier fluid is preferably an intensifier plunger pump which has bearing surfaces (203) to guide a reciprocating cylinder (204). One end of the reciprocating cylinder (204) is closed and carries a plunger (201) and a connection (215) for driving fluid to enter the cylinder for the pump return stroke. The other end of the cylinder (204) has a piston (205) movable within a fixed cylinder (206) on which driving fluid acts during the pump delivery stroke.

14 Claims, 7 Drawing Sheets

FLUID ABRASIVE JETS FOR MACHINING

This invention relates to apparatus to produce a flow of abrasive particles in a pressurised carrier fluid for the machining of materials. The carrier fluid is normally water and the abrasive a sand such as garnet. The apparatus described is particularly suitable for producing abrasive water jets less than 100 μm (microns) in diameter to meet a growing need for micro machining of high technology, difficult to machine metals, ceramics, polymers and composite materials.

The use of abrasive particles in a fluid jet is a well known method of machining. Commercially the most important form of apparatus for abrasive fluid machining uses highly pressurised water discharged through a 0.2 to 0.4 millimeter diameter nozzle to form a jet travelling at up to 800 meters per second. The water jet traverses an enclosed space before entering a ceramic focusing tube. Air laden with abrasive particles is inducted by the jet into the enclosed space and entrained into the focusing tube by the jet. In the focusing tube energy is transferred from the water to the abrasive particles to accelerate the particles to a velocity greater than 300 meters per second. The jet of water, abrasive and air leaving the focusing tube is directed onto the workpiece to be machined. In order for the entrainment process to work the focusing tube cross sectional area needs to be about 10 times greater than that of the initial cross sectional area of the high velocity water jet. This increase in area, combined with energy losses in the focusing tube results in the mean energy density of the water and abrasive impacting on the workpiece being about one twentieth of that of the water jet. However, by using ultra high pressures of 250 to 400 MPa (2500 to 4000 bar) to drive the water jet abrasive particle energy densities at the workpiece are sufficient to economically machine a wide range of engineering materials.

Typically abrasive water jets form by entraining abrasive into a high velocity water jet have diameters between 0.7 to 1.2 millimeters and these jets produce cut widths of 0.75 to 1.3 millimeters. Machining efficiency drops off rapidly as jet diameters are decreased below 0.7 millimeters and additional features are required at diameters less than 0.5 mm to induce sufficient air flow to convey the abrasive particles prior to their entry into the focusing tube. Patent No. EP 0 391 500 A2 describes apparatus that extends the operation of entrainment abrasive water jets down to 0.25 millimeters diameter, which is probably the lower economic limit for entrainment jets.

To produce abrasive water jets that do not suffer from the jet size restrictions inherent in the entrainment process, it is necessary to mix the abrasive with the water before the water is accelerated to a high velocity in a nozzle. The abrasive particle acceleration process in nozzles designed for abrasive in carrier fluids are efficient, so the jet energy densities at workpieces are close to those in the nozzle and the cut widths produced are similar to the nozzle diameter. Because of the efficient acceleration of the abrasive particles, water pressures can be reduced to 25 percent of those needed by entrainment abrasive water jet equipment. Lower water pressures are desirable because the abrasive storage, metering and flow control systems have to operate at the carrier fluid pressure, resulting in more complex apparatuses than those needed to generate entrainment abrasive water jets. The apparatus also has to accommodate complex fluid/particle and flow phenomena, and these phenomena grow in importance as abrasive particle size and fluid flow rates decrease.

One form of apparatus for generating abrasive in a carrier fluid meters abrasive particles from a storage vessel by directing about 10 percent of the water flow from a pressurised water source through the abrasive storage vessel to fluidise and carry abrasive particles out of the vessel into the approximately 90 percent of the water that bypasses the vessel. The division of pressurised water between the vessel flow circuit and the bypass circuit is achieved by restrictors in the vessel flow circuit and in the bypass flow circuit. The relative sizes of the restrictors in the vessel and bypass flow circuits determines the abrasive to water concentration at the nozzle. In the nozzle the pressure energy of the water is converted to velocity energy and the water and abrasive particles are accelerated to velocities of about 300 m/s for a water pressure of 500 bar and 500 m/s for a water pressure of 1500 bar.

Fluid compressibility is important at the pressures required to drive abrasive in carrier fluid jets. In the case of water, the volume decrease is about 1 percent per 250 bar of pressure. Water in the voids between abrasive particles occupies about 50 percent of the volume of a bed of abrasive in abrasive storage vessels and there is usually a water filled space above the abrasive bed. The volume of compressed water in abrasive storage vessels is typically equivalent to 2 to 10 seconds of the steady state pressurised water flow to the apparatus. When the supply of pressurised water is reduced or stopped the compressed water in the abrasive storage vessel expands to relieve the pressure in the vessel via the nozzle. As the compressed water expands it can cause high concentrations of abrasive in the water flowing out of the vessel and carry abrasive particles into parts of flow circuits where they can damage valves and other components.

The amount of abrasive that is expelled from an abrasive storage vessel when it is depressurised via the cutting nozzle is at a maximum when the restrictor in the abrasive vessel flow circuit is located on the inlet side of the vessel. The easiest flow path for expanding carrier fluid is out of the bottom of the vessel, generating flows that can be 80 percent of abrasive by weight. This is well above the 40 to 50 percent abrasive concentration level at which nozzle blockage is highly likely. The restrictor is usually located on the inlet side of the abrasive storage vessels because restrictors on the outlet side are more prone to blockage and wear.

It is normal to provide a means of depressurising the abrasive storage vessel via a valve to a low pressure region but it is not practical to operate the valve to deal with all upset conditions. Patent Application No. PCTIGB95/00979 describes flow circuits that use a jet pump located in the abrasive storage vessel flow circuit on the inlet side of the vessel. One of the functions of the jet pump is to provide an easier route for carrier fluid from the top of abrasive storage vessels to the nozzle during depressurisation. Another function is to reverse the flow in part of the abrasive storage vessel flow circuit to clear abrasive from the circuit. With cutting nozzles less than 0.2 millimeters in diameter the Reynolds Numbers (ratio of inertia to viscous forces) of the 10 percent of the pressurised water supply passing through the abrasive storage vessel flow circuit are so low that laminar rather than turbulent flow occurs. Fluid entrainment processes, on which the operation of jet pumps rely, are very poor in laminar flows, so the apparatus described in PCT/GB95/00979 will not function effectively at the jet sizes required for micro machining.

One method of preventing the fall off in jet pump performance is to increase the jet pump driving pressure by decreasing the diameter of the restrictor that produces the driving jet. In practice, this is not an option for jet pumps operating on the 10 percent or so of the flow that passes through the abrasive storage vessel flow circuit because they have restrictor diameters close to those of the abrasive particles and are therefore at risk of blockage by particles that reach the restrictor. The flow circuits disclosed in this invention utilise a jet pump that operates on the total supply of pressurised water to the apparatus thereby overcoming Reynolds Number and pressure drop limitations.

It is desirable that the machining action of abrasive water jets can be started and stopped many times per second, particularly when drilling thin materials, etching details into surfaces and milling features on workpieces. Driving pressures for carrier fluid abrasive jets are sufficiently low that many materials are not damaged by short exposure to jets without abrasive. Rapid on/off machining action can therefore be achieved by starting and stopping the abrasive feed whilst leaving the carrier fluid flowing through the nozzle. The stopping of abrasive feed has to be absolute because workpiece surfaces can be marked by individual particles striking the surface. Typically, a 50 $\mu$m (micron) jet will have a particle flow rate in excess of 10 million particles per second. Such high particle flow rates cannot be started and stopped cleanly by the use of a valve in the abrasive vessel flow circuit. The invention disclosed provides for rapid starting and stopping of abrasive particle flow by using a jet pump, in association with other devices, momentarily to reverse the flow in the abrasive storage vessel circuit to produce a clean cut off in abrasive flow at the nozzle. This capability also allows the water flow to the nozzle to be started and stopped quickly by a valve in the conduit to the nozzle that is operated as soon as the abrasive flow is stopped.

One oversize particle can block a nozzle. Abrasives are typically produced by crushing a sand, such as garnet, to produce fine particles that are then graded to a maximum particle size of about 60 percent of the nozzle diameter. For instance, the particles for a 50 $\mu$m (micron) nozzle would have a maximum diameter of about 30 $\mu$m (microns), which is less than the diameter of human hair and smaller than many dust particles and other potential contaminants. In order to avoid particles that can block a nozzle it is essential that once the abrasive is graded, it is isolated from the general environment. The apparatus disclosed can utilise abrasive in sealed cartridges that are loaded into or connected to the apparatus.

Flow passages within the apparatus cause the 90 percent or so of carrier fluid that bypasses the abrasive storage vessel to flow over the downstream face of a restrictor located in the outlet from the abrasive storage vessel. This minimises the risk of blockages downstream of the restrictor and provides abrasive free carrier fluid at the restrictor immediately to clear abrasive from the restrictor when the flow is reversed in the abrasive storage vessel circuit. When the restrictor in the abrasive storage vessel flow circuit is located in the inlet to the vessel, the 90 percent or so of carrier fluid that bypassed the abrasive storage vessel flows to the base of the vessel where the flow passages are arranged so that a clean cut off of abrasive occurs when flow is reversed in the abrasive storage vessel circuit.

The diameter of abrasive particles relative to the diameter of a restrictor at the outlet of abrasive storage vessels can be such that particle bridging occurs at restrictor inlets. Bridging causes further accumulation of particles resulting in the formation of a filter bed that cuts off the flow of abrasive. The capability of the apparatus momentarily to reverse the flow in the abrasive storage vessel circuit provides a means of hindering the formation of bridges and of destroying bridges that form.

When the apparatus disclosed is used for micro machining, the abrasive storage vessel can hold sufficient abrasive to machine several workpieces but when versions of the apparatus are used with larger nozzles, and hence higher abrasive flow rates it is desirable that the storage vessel is refilled with abrasive whilst machining operations are carried out. Adaptations to the apparatus provide for refilling the abrasive storage vessel from a refill vessel.

For micro machining applications, the apparatus requires flow rates from a fraction of a liter per hour up to 10 liters per hour at pressures over 300 bar and with a pressure ripple less than about 5 percent. Plunger pumps are required to meet the flow and pressure requirements, but they cause very high pressure ripple. The well known methods of minimising pressure ripple from intensifier plunger pumps are to include an accumulator in the flow circuit to dampen out variations in pressure/flow or to use two plunger pumps that are phased such that, before one of the pumps reaches the end of its delivery stroke, the other pump begins it delivery stroke and is up to the operating pressure before taking over the pumping role.

Accumulators are not an acceptable solution for minimising pressure ripple in many micro abrasive waterjet flow circuits, making phased intensifier pumps the preferred option. Hydraulically driven phased intensifier pumps have been developed for water jet and abrasive water jet applications, but they are too powerful, bulky, complex and expensive to be used for most micro abrasive waterjet applications.

Commercially available intensifier pumps for the pressure and flow ranges required for micro abrasive water jets use compressed air at about 7 bar pressure to drive a piston that is 50 to 400 times larger in area than that of the water pressurising plunger connected to the piston. These pumps have mechanical valve mechanisms that turn on the air for the delivery stroke and vent the air at the end of the delivery stroke. A spring returns the piston for the start of the next delivery stroke. The mechanical valve mechanisms are not suited to phased operation of two pumps and the reliability of this type of intensifier pump is low because the high number of moving parts in the valve assemblies and the less than ideal guidance and support of the pump plunger.

The intensifier plunger pump disclosed herein has bearing surfaces on the body of a plunger pump to guide a reciprocating cylinder. One end of the reciprocating cylinder is closed and carries the pump plunger and a connection for driving fluid to enter the cylinder for the pump return stroke. The other end of the cylinder has a piston on which driving fluid acts during the pump delivery stroke. The piston moves within a fixed cylinder, one end plate of which provides support for the pump body, while the other end plate carries a seal through which the reciprocating cylinder extends. The advantages of the pump include.

1. Accurate plunger alignment in the pump body provided by bearing surfaces on the rigid pump body that guide the reciprocating cylinder which carries the pump plunger. Buckling loads on the plunger are minimised, allowing high plunger stroke lengths to plunger diameter ratios and the use of ceramic plungers which have excellent wear and sealing characteristics, but being brittle, fracture under excessive buckling forces. High stroke length to plunger diameter ratios decreases the frequency of pump stroking with benefits for pump reliability and the life of components in the control system for the pump driving fluid.
2. Simple pump construction that is easy to manufacture and to service. In particular the pump and reciprocating cylinder can be installed within commercially available compact pneumatic cylinders. The piston assemblies of proprietary pneumatic cylinders can be machined to allow the piston to slide onto the reciprocating cylinder of the plunger pump and the cylinder end plates modified to accommodate the pump body and reciprocating cylinder.

3. Compact size, low weight and low reaction forces on the pump mountings. This makes it practical to mount the complete apparatus on the robotic motion system for the cutting nozzle, with benefits for fast abrasive on/off operations, a compact machining installation and safety through the absence of any long lengths of high pressure tubing.
4. The pump body acts as a piston for the plunger return stroke. The cross-sectional area of the pump body is about 20 percent of the area of the pump driving piston and as such is sized for returning the plunger ready for a new delivery stroke, using the same fluid pressure as for the delivery stroke. This feature reduces driving fluid consumption and the transient loads transmitted to the pump mountings.
5. Conventional magnetic piston location sensors can be used to provide the signals for micro processor based systems to control solenoid valves in the pump driving fluid circuits. These solenoid valves can be programmed to phase the operation of two of the pumps to provide a source of high pressure fluid with a low pressure ripple.

According to a first aspect of the invention, there is provided an apparatus to provide a supply of abrasive particles in carrier fluid to a nozzle for machining purposes, characterised in that the apparatus comprises a storage vessel for abrasive particles, a source of pressurised carrier fluid, first conduit means to convey at least a major proportion of said incoming carrier fluid to a nozzle, second conduit means to connect said source of carrier fluid to an inlet of the storage vessel, third conduit means to connect an outlet of the storage vessel to said nozzle, switching means selectively operable either to allow a minor proportion of said incoming carrier fluid to flow through said second conduit means to said storage vessel, to produce a flow of abrasive particles in carrier fluid in said third conduit means, or alternatively to direct substantially all of said carrier fluid through said first conduit means, said switching means further comprising means to cause reversal of flow in said second and said third conduit means, thereby stopping abrasive particle flow to the nozzle.

Preferably the switching means comprises a valve openable to allow fluid flow through said second conduit means and closable to cause all of the flow to pass through said first conduit means.

The means to cause flow reversal may comprise jet pump means so located adjacent said first conduit means that, when all of the carrier fluid is directed through the first conduit means, fluid from said second conduit means is entrained into said first conduit means, thereby initiating flow reversal.

In this case the switching means may comprise deflector means activatable to disrupt the fluid flow through said jet pump means adjacent a point where said first conduit means is connected to said second conduit means.

Advantageously valve means are provided to stop reverse flow in said second and third conduit means when said third conduit means is cleared of abrasive particles.

The storage vessel for abrasive particles is preferably fillable with particles in the absence of pressurised carrier fluid and is connectable to said second and third conduit means.

The storage vessel may comprise a container of abrasive particles, and a housing for said container, said housing comprising such connection means that when said housing is closed, said container is connected to said second and third conduit means.

In this case the connection means may comprise sealing means in said connection means to said second and third conduit means and means to stop reverse flow in said third conduit means.

A second storage vessel for abrasive particles may be fillable in the absence of pressurised carrier fluid and may have an outlet openable to allow the contents thereof to be transported to said storage vessel under the pressure of the carrier fluid.

According to a second aspect of the invention, a container for use with the apparatus described above may comprise initially sealed connector means adapted to connect with said second and third conduit means and openable when connected thereto.

According to a third aspect of the invention, a method of providing a supply of abrasive particles in carrier fluid to a nozzle for machining purposes comprises the steps of providing a storage vessel for abrasive particles, providing a source of pressurised carrier fluid, conveying at least a major proportion of said pressurised carrier fluid to a nozzle, switching the flow of said incoming fluid selectively to allow either a minor proportion of said incoming carrier fluid to flow to said storage vessel, and thence, with the inclusion of abrasive particles, to said nozzle, or alternatively to direct all of said carrier fluid directly to the nozzle in such a manner that fluid from said second conduit means is entrained thereby to initiate reversal of flow at said storage vessel.

According to a fourth aspect of the invention, a method of machining a workpiece comprises directing onto said workpiece a jet of abrasive in carrier fluid issuant from a nozzle and supplied by an apparatus as above, in which operation of the switching means from one mode to the other will cause the jet to comprise either carrier fluid alone, or carrier fluid plus abrasive particles, the changeover being substantially instantaneous and complete.

According to a fifth aspect of the invention, an intensifier pump for use with the apparatus described above comprises a first fixed cylinder, a first piston adapted to be acted on by drive fluid so as to be movable therewithin, a reciprocating second cylinder connected to and movable with said first piston, a second fixed piston cooperable with said reciprocating cylinder, and a pump plunger so carried by a closed end of said reciprocating cylinder as to act along a cylindrical bore within said fixed piston to provide a source of pressurisation for said carrier fluid when said first piston is acted upon by drive fluid.

In this case driving fluid may be supplied alternately to said first cylinder and first piston and to said reciprocating second cylinder and second fixed piston.

Embodiments of the invention will now be described by way of example and with reference to the accompanying drawings, in which.

Figure 1:
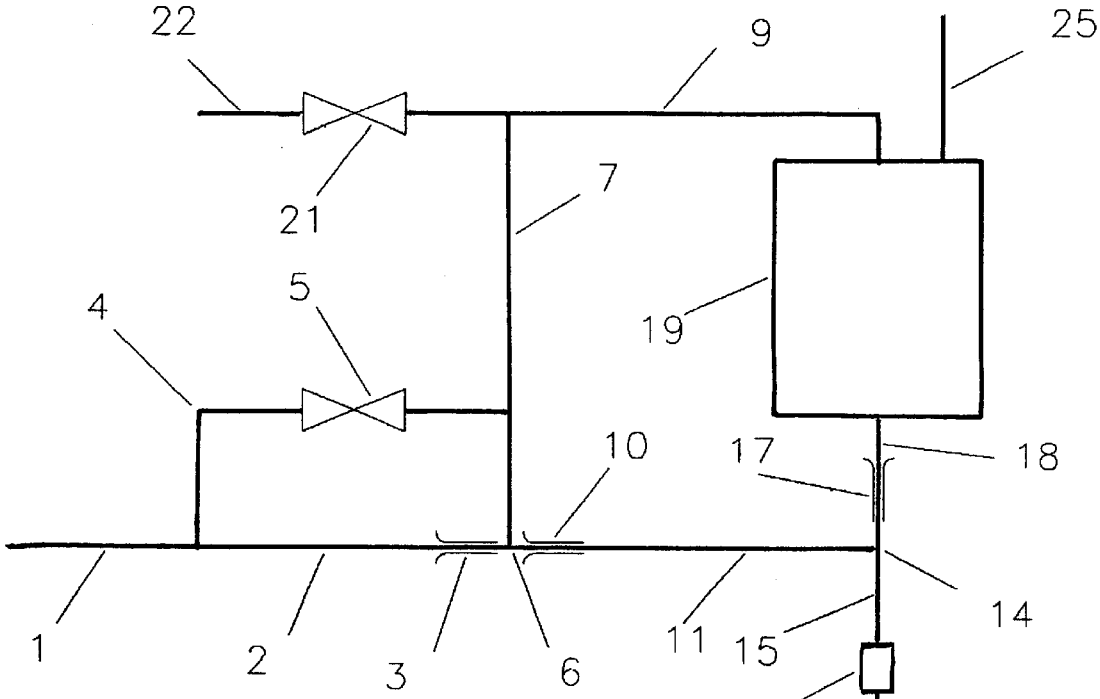
FIG. 1 is a flow diagram of an abrasive in carrier fluid supply apparatus.

Referring now to FIG. 1, pressurised fluid enters the apparatus through conduit 1. When valve 5 is open, some of the fluid passes through conduit 4 and valve 5 to conduit 7 where it combines with a small percentage of the flow that passed through conduit 2 and restrictor 3 to junction 6. Of the total incoming flow, about 90 percent bypasses an abrasive storage vessel 19 by flowing through restrictor 10 and conduit 11 to junction 14. The other 10 percent or so of the fluid flows through conduit 9 to storage vessel 19, where it fluidises and carries abrasive particles out of the vessel through conduit 18 and restrictor 17 to junction 14, where it rejoins the 90 percent or so of flow that bypassed the storage vessel. From junction 14 the fluid and abrasive particles pass through conduit 15 to the cutting nozzle 16, where the pressure energy of the carrier fluid is converted to velocity energy to form an abrasive fluid jet 23. The abrasive concentration at the nozzle depends on the proportion of the carrier fluid that passes through the abrasive storage vessel flow circuits 9, 19, 18 and 17. The proportion of the fluid that passes through the abrasive storage vessel circuit is proportional to the ratio of the area of restrictor 17 to restrictor 10. For 10 percent carrier fluid flow in the abrasive storage vessel circuit, the abrasive concentration at the nozzle is about 10 percent by weight.

When valve 5 is closed all the pressurised fluid from conduit 1 passes along conduit 2 and through restrictor 3 across junction 6 and into restrictor 10. The flow area of restrictor 3 is less than the flow area of restrictor 10 which is located close to the outlet of restrictor 3. The combination of restrictor 3 and restrictor 10 acts as a jet pump, with restrictor 10 forming a mixing tube in which part of the velocity energy in the jet from restrictor 3 is converted into a static pressure rise. This results in the static pressure in conduit 11 and junction 14 being higher than in conduit 7 and junction 6, causing flow to reverse in the abrasive storage vessel circuit as fluid from conduit 7 is entrained into the jet from restrictor 3 at junction 6. The abrasive supply to the nozzle is therefore stopped by the closing of valve 5 and turned on by opening valve 5.

The pressure difference across restrictor 3 can be varied to adjust the rate at which fluid is recirculated from junction 14 to junction 6 via the abrasive storage vessel 19. For cutting nozzle diameters sufficient for flows within the flow circuits to be turbulent, restrictor 3 is sized for a pressure difference of about 1 percent of the pressure difference across the cutting nozzle 16. With nozzle diameters below about 50 $\mu$m (microns), the Reynolds Numbers of the flow in the restrictors approaches those associated with laminar flows requiring that the pressure difference across restrictor 3 be increased to maintain turbulent processes in restrictor 10.

To stop the flow of carrier fluid from the nozzle 16 in a controlled manner, the abrasive flow to the nozzle is first stopped by closing valve 5 followed by opening valve 21 to release fluid through conduit 22 to a low pressure sink. After a short delay, to allow the compressed water in abrasive storage vessel 19 to expand, the supply of fluid in conduit 1 is stopped in a controlled manner. If the apparatus is discharging carrier fluid through nozzle 16, with or without abrasive, and the supply of pressurised carrier fluid in conduit 1 is abruptly stopped or decreased, expansion of the compressed carrier fluid in the abrasive storage vessel 19 will result in flows out of the top and out of the bottom of the abrasive storage vessel 19, in some proportion to the areas of flow restrictors 10 and 17, which is the same proportion as the abrasive flow to the nozzle 16 when valve 5 is open and the apparatus is operating normally.

Figure 2:
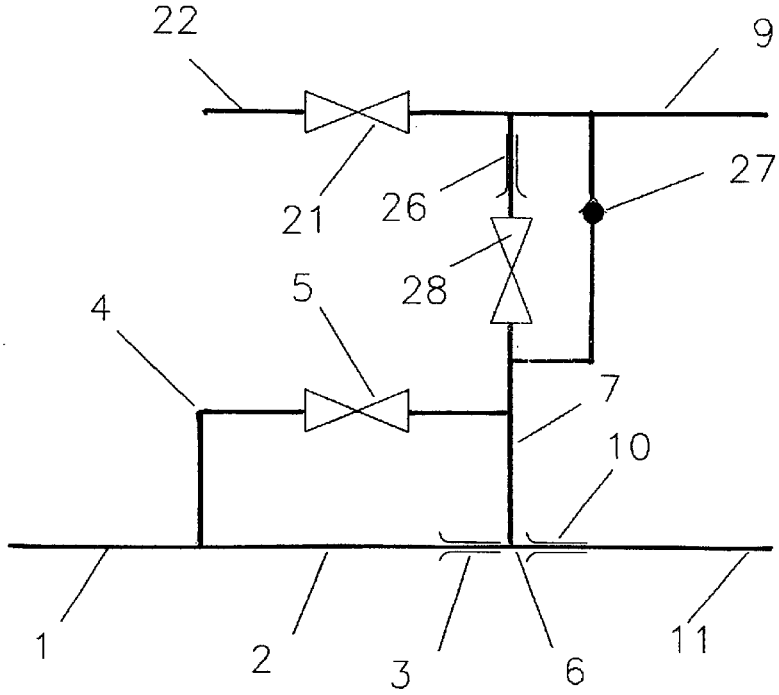
FIG. 2 is a flow diagram of part of the apparatus of FIG. 1, having a restrictor in the second conduit.

FIG. 2 shows a restrictor 26 for the abrasive storage vessel flow circuit located in conduit 7. Restrictor 26 may be used in place of restrictor 17 of FIG. 1 or it may be used in conjunction with restrictor 17. When both restrictor 17 and 26 are used together, the diameter of restrictor 17 can be increased to reduce the tendency for restrictor 17 to be blocked by abrasive particles. A non-return valve 27 provides a low pressure loss route to the nozzle 16 for carrier fluid from the top of the abrasive storage vessel during depressurisation of the vessel via the nozzle 16. Non-return valve 27 opens when the pressure in abrasive storage vessel 19 exceeds that at junction 6 by the opening pressure of non-return valve 27. Valve 28 is used to stop flow in the abrasive storage vessel circuit except for conditions when a pressure differential causes the non-return valve 27 to open.

Figure 3:
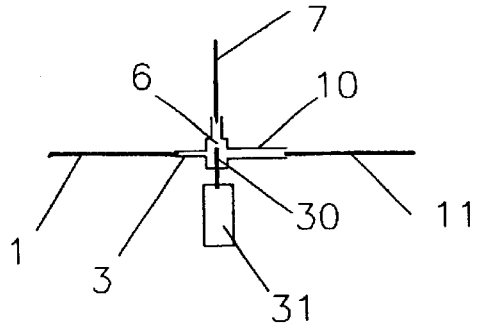
FIG. 3 shows a form of jet deflector.
Figure 4:
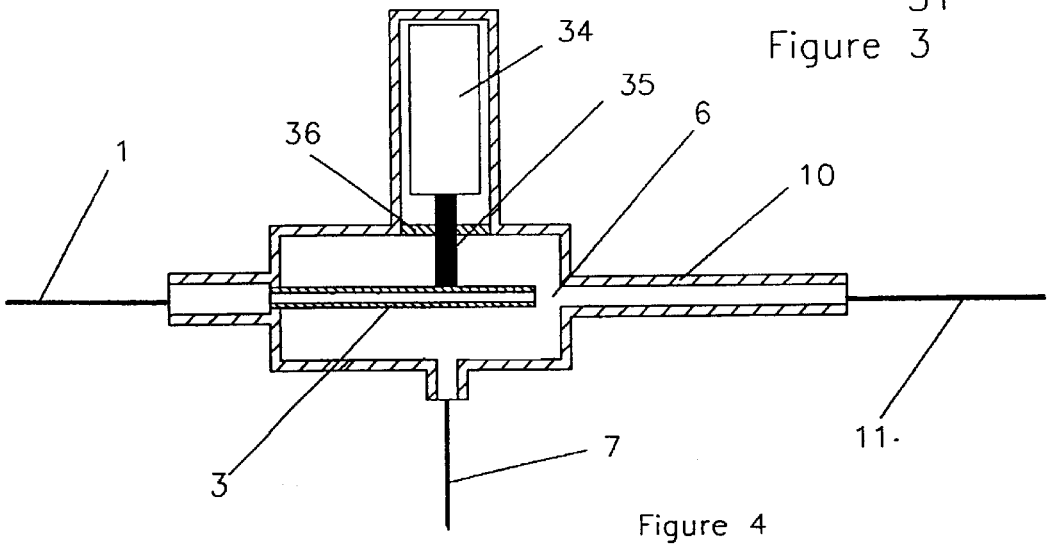
FIG. 4 shows another form of jet deflector.

Apparatus with the flow circuits shown in FIGS. 1 and 2 are particularly beneficial when the energy of the fluid jet without abrasives does not damage the workpiece being machined. This is the case for most metals and many other materials. By coordinating the operation of valve 5 with the operation of the manipulator for the cutting nozzle 16, the abrasive feed to the nozzle can be briefly stopped whilst the nozzle is moved to the new cutting location. This mode of operation maximises the time the apparatus is carrying out cutting, drilling and milling operations. When machining fine detail, it is desirable to be able to switch the abrasive on and off many times per second. To achieve as rapid on/off of abrasive as practical at the nozzle 16, the starting and stopping of the jet pump action at junction 6 can be more rapidly achieved by deflecting the jet from restrictor 3, rather than reducing the flow from restrictor 3 by opening valve 5. FIGS. 3 and 4 show arrangements for interrupting the jet from restrictor 3 to stop the jet pump action.

FIG. 3 shows a jet deflector 30 located at junction 6 which can be positioned to deflect the jet from restrictor 3, so that it does not impinge on the inlet to restrictor 10. When the deflector 30 is not affecting the jet flow, conditions are the same as for the circuits in FIG. 1 with valve 5 closed to turn the abrasive feed off. When the deflector 30 is moved to deflect the jet and stop the jet pump action, abrasive discharge from abrasive storage vessel 19 is turned on. The deflector is driven by actuator 31, which can be a linear actuating device, rotating disc with holes or other well known device. The actuator 31 can be located within the pressure containment of the apparatus to avoid moving parts with high pressure seals.

FIG. 4 shows restrictor 3 as a hollow cantilevered beam that discharges into fixed restrictor 10. Acting on the hollow cantilever beam restrictor 3 is an actuating member 35 driven by actuator 34 that operates to bend the cantilever beam restrictor 3 and stop the jet pump action of the jet from restrictor 3 into restrictor 10 at junction 6. Stopping the jet pump action turns on the abrasive discharge from the abrasive storage vessel 19. Actuator 34 could take the form of an electrical solenoid, piezoelectric linear or cantilever actuator, magnetic device attached to the beam or any other known actuating mechanism. The actuator 34 can be placed within the pressure containment by filling it with a non conducting fluid that is separated from the carrier fluid by diaphragm 36. With the actuator within the pressure containment, unbalanced pressure forces on the actuating member 35 are avoided, along with the need for a high pressure dynamic seal for the actuating member 35. When the actuator 34 is located within the pressure containment, the force exerted on the actuator member 35 by the cantilevered beam restrictor 3 can be used to return the actuator to its starting position. This is particularly useful if the actuating member is the plunger of an electrical solenoid, since a return spring is not required for the plunger. The arrangement shown in FIG. 4 allows the outlet of restrictor 3 to be closer to the inlet of restrictor 10 than can be achieved with the interrupter 30 arrangement of FIG. 3. An alternative arrangement to that shown in FIG. 4 is to have restrictor 3 fixed and restrictor 10 as a hollow beam on which the actuator member 35 operates.

Figure 5:
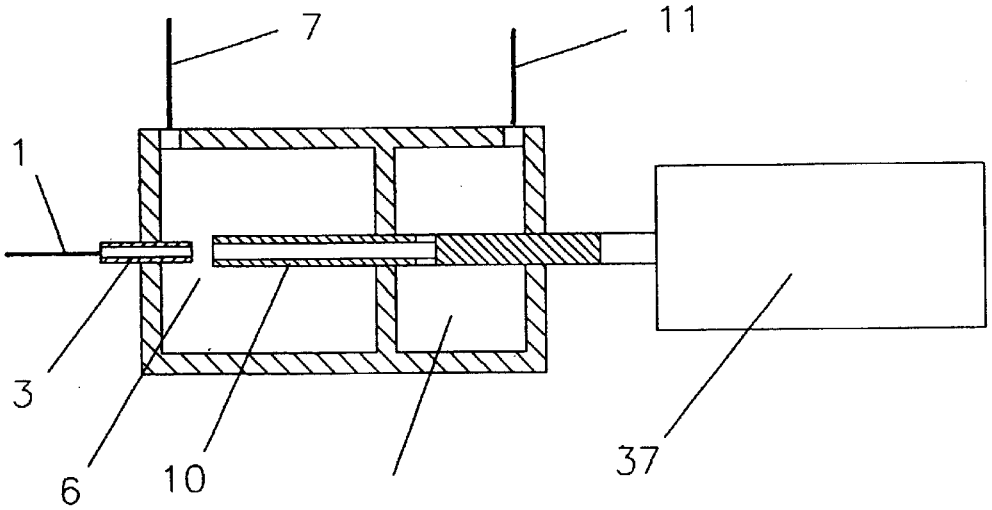
FIG. 5 shows a longitudinally movable jet pump.

FIG. 5 shows an arrangement for varying the distance between the outlet of restrictor 3 and the inlet to restrictor 10, in order to stop or decrease the jet pump action at junction 6. Actuator 37 positions the inlet of restrictor 10 at varying distances from the outlet of restrictor 3. With restrictor 10 positioned away from the outlet of restrictor 3, jet pump action is negligible and abrasive is turned on by flow from junction 6 to both conduits 7 and 11. With the inlet of restrictor 10 positioned close to restrictor 3, jet pump action at junction 6 entrains fluid from conduit 7 and abrasive discharge from the abrasive storage vessel is turned off. An alternative arrangement to that shown in FIG. 5 is to have flow passages that allow restrictor 3 to be moved relative to a fixed restrictor 10.

By controlling the position of valve 5 in FIG. 1, or the interrupter 30 of FIG. 3, or the cantilever beam restrictor 3 of FIG. 4, or the moveable restrictor 10 of FIG. 5, the jet pump action of the jet from restrictor 3 into restrictor 10 at junction 6 can be varied. By varying the jet pump action, the amount of carrier fluid flowing in the abrasive storage vessel circuit can be controlled from a negative flow, through zero flow, up to that set by the relative flow areas of restrictor 17 to restrictor 10. A consequence is that the abrasive concentration at the nozzle can be controlled from zero to a maximum set by the relative areas of restrictors 10 and 17. To aid in controlling the abrasive concentration level at the nozzle, the interrupter 30 in FIG. 3 can be profiled on its interrupting surfaces or the outlet of the cantilevered tube restrictor 3 of FIG. 4, and/or inlet to restrictor 10, can be shaped.

When the abrasive flow from abrasive storage vessel 19 is stopped by reversing the carrier fluid flow through the vessel, the carrier fluid entering the base of storage vessel 19 causes the bed of abrasive particles in the vessel to expand. This results in a higher concentration of carrier fluid in the abrasive bed, local to the inlet to conduit 18. When abrasive is again turned on, the flow out of the storage vessel through conduit 18 initially has a lower than required abrasive concentration, and this may upset machining processes. To avoid variable abrasive concentrations, the reverse flow in the abrasive storage vessel circuit should only persist for a short time. Two methods of achieving this are presented with reference to FIGS. 6 and 9.

Figure 6:
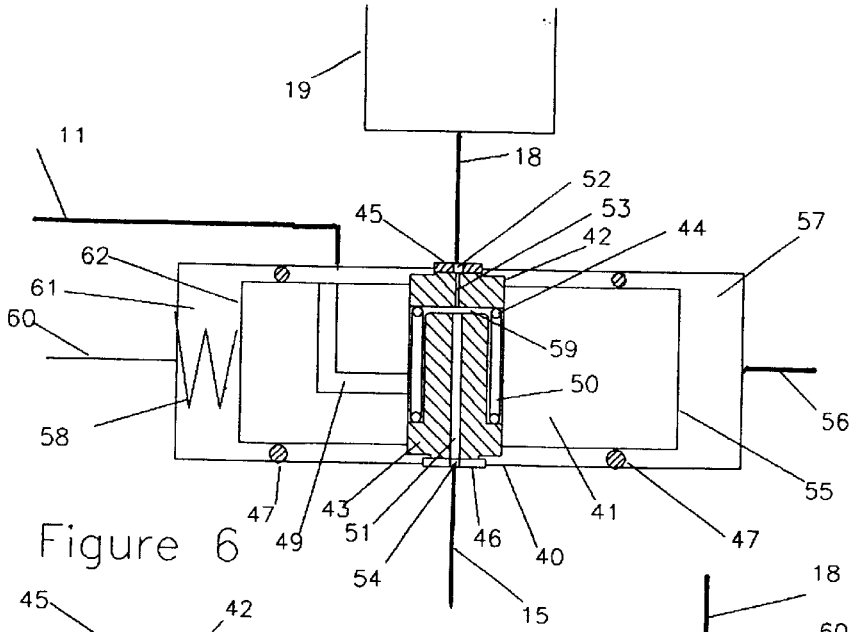
FIG. 6 shows a fluid isolation valve to stop reverse flow.

The abrasive and carrier fluid isolation valve shown in FIG. 6 provides the means to stop the reverse flow through the abrasive storage vessel 19, and also to stop carrier fluid flow to, the cutting nozzle 16. The valve is installed where conduit 11 and conduit 18 meet at junction 14. Referring to FIG. 6, a housing 40 contains a slide 41 in which are located sliding seats 42 and 43 that are loaded by a spring against seats 45 and 46 fixed in body 40. The flow passage in seat 45 is connected to the storage vessel 19 by conduit 18. Fluid that bypassed the storage vessel enters the valve through conduit 11 into a space between the body 40 and the slide 41 that is sealed by seals 47. It then flows through passage 49 in the slide 41 to a space 50 that is part occupied by a spring 44, where it is joined by any fluid that reaches space 50 through the clearances between sliding seats 42 and 43 and the slide member 41. The bypass fluid flows from space 50 through a gap 59 between seats 42 and 43, into flow passage 51 in seat 43, where it mixes with fluid and abrasive from the abrasive storage vessel circuit that entered the valve from conduit 18 and the passages 52 and 53 in seats 45 and 42. The flow passage 53 in seat 42 acts as the restrictor for the abrasive storage vessel circuit carrying out the functions of restrictor 17 of FIG. 1. The combined flows leave passage 51 in sliding seat 43 through passage 54 in seat 46 to conduit 15 that connects to the cutting nozzle.

The flow paths through the valve for carrier fluid from conduit 11 are arranged to stop abrasive particles reaching sliding surfaces within the valve except for the surfaces between items 42 and 45, and between 43 and 46. The mating surfaces between these items are lapped or highly machined and the surfaces held in contact with one another by spring 44 to prevent abrasive particles penetrating between the surfaces.

Figure 7:
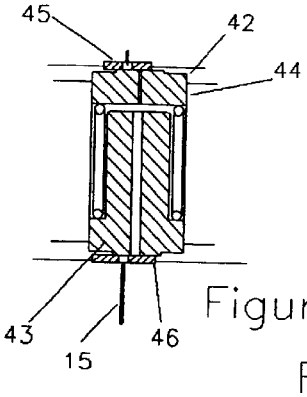
FIG. 7 is a scrap view of the valve shown in FIG. 6 in closed condition.

A force applied to the end 55 of the slide member 41 by driving fluid through conduit 56 into space 57, or by other means of applying a force, aligns flow passages 52 and 53, 51 and 54, as shown in FIG. 6. When the force on 55 is removed, spring 58, or driving fluid through conduit 60 into space 61 or other means of applying a force to the end 62 of the slide member 41, moves the seats 42 and 43 to seal the inlet from the storage vessel conduit 18 and the outlet from the valve to conduit 15 as shown in FIG. 7. The diameter of the passageways 51 and 54 are larger than passageways 52 and 53. Moving the slide 41 to an intermediate position between those shown in FIGS. 6 and 7, the flow passages 52 and 53 in seats 45 and 42 can be sealed whilst leaving an adequate flow area between the non aligned passageways 51 and 54 in seats 43 and 46. This allows the storage vessel flow circuit to be isolated whilst. all the pressurised fluid flows through the bypass circuit to the nozzle.

The abrasive and carrier fluid isolation valve of FIG. 6 is operated in conjunction with valve 5 in FIG. 1 or the devices in FIGS. 3 to 5. With actuating pressure applied at 56 to align passages 52, 53, 51 and 54, and no jet pump action at junction 6, abrasive in the carrier fluid flows to the cutting nozzle through conduit 15. When the jump pump action is started and reverse flow induced in the abrasive storage vessel circuit, the valve is operated after a short delay to allow the reverse flow to clear abrasive particles from passageways 52, 53, 51 and 54. If flow from the nozzle is to be stopped, the slide is moved so that the passageway 51 is completely sealed by seat 46. If the flow of pressurised carrier fluid is to continue flowing to the nozzle, the slide 41 is moved to seal passageway 53, but to leave passageway 51 open to passageway 54.

Figure 8:
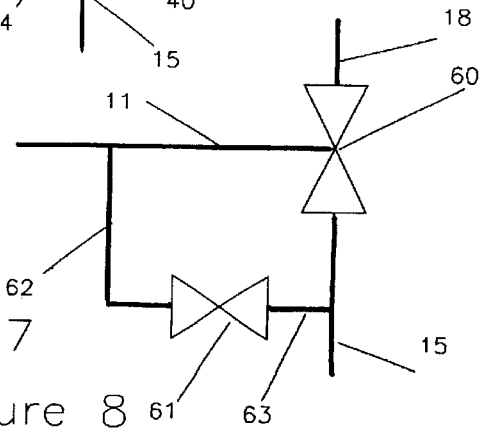
FIG. 8 is a flow diagram of a bypass circuit between first and third conduits.

To reduce the actuating forces on slide 41 when the flow of carrier fluid to the nozzle is to be stopped or started, a bypass circuit from conduit 11 to conduit 15 can be used as shown in FIG. 8. Valve 61 connected to conduit 11 and conduit 15 is opened briefly as slide 41 moves and is then closed.

Figure 9:
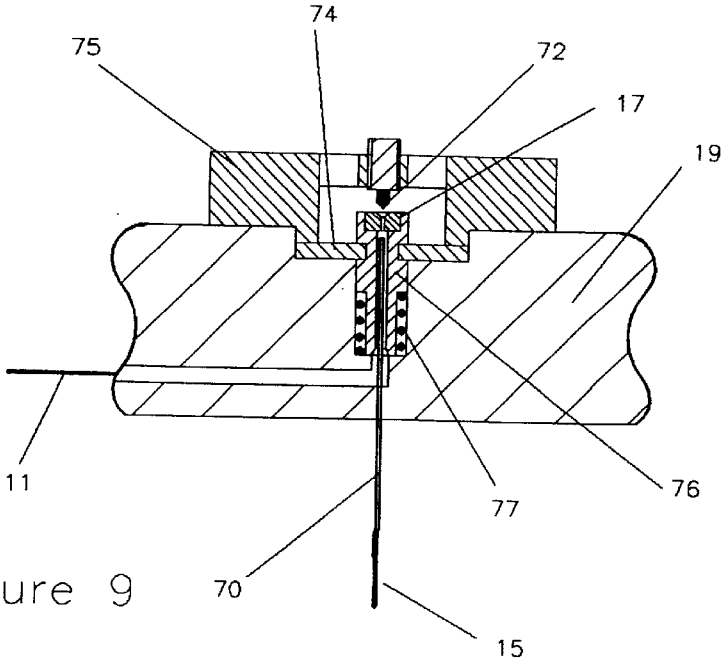
FIG. 9 shows an alternative form of fluid isolation valve.

The abrasive isolation assembly shown in FIG. 9 is an alternative arrangement to the abrasive and carrier fluid isolation valve of FIG. 6 for stopping the reverse flow in the abrasive storage vessel flow circuit shortly after starting jet pump action at junction 6. The abrasive isolation assembly in FIG. 9 also stops abrasive flow out of the abrasive storage vessel 19 when the apparatus is not pressurised and when abrasive is being loaded into abrasive storage vessel 19.

Restrictor 17 is carried in piston 76 that slides in the base of the abrasive storage vessel 19. The piston is connected to diaphragm 74 and has a spring 77 that loads the restrictor against seat 72. Seat 72 is located in retainer 75, which is attached to the abrasive storage base so as to retain the diaphragm 74. The restrictor 17 and the diaphragm are in contact with the abrasive and carrier fluid in vessel 19 by means of ports in retainer 75. A tube 70, connected to conduit 15, is sealed to the bottom of the abrasive storage vessel and extends through a passage connected to conduit 11 and a centrally located passage in the piston 76. The tube 70 terminates just below restrictor 17 or restrictor 17 seats on tube 70, in which case tube 70 has slots or holes for carrier fluid to enter the tube 70 from the annular space between the tube 70 and the piston 76. The tube 70 can have guide pads or other means to hold it centrally in piston 76.

Carrier fluid from conduit 11 enters a passageway in the abrasive storage vessel and flows into the annular space between tube 70 and piston 76. At the underside of the restrictor 17, the carrier fluid enters the tube 70 along with any carrier fluid and particles that have passed through restrictor 17. When the apparatus is not operating, spring 77 holds the restrictor against seat 72. When the apparatus is operating and abrasive is selected to be on by stopping the jet pump action at junction 6, the pressure differential across restrictor 17, acting on the piston 76 and diaphragm 74, moves the piston to allow abrasive in carrier fluid to discharge from the storage vessel through restrictor 17. When abrasive is selected to be off by starting the jet pump action at junction 6, the pressure differential across the abrasive isolation assembly reverses and carrier fluid entering from conduit 1 flows through restrictor 17 into abrasive storage vessel 19, cleanly cutting off the flow of abrasive to the nozzle 16.

Depending on the time between turning abrasive off and turning it on again, piston 76 carrying restrictor 17 may or may not move sufficiently for restrictor 17 to seal against seat 72 before the pressure difference across the assembly is reversed to restart abrasive flowing to the nozzle 16.

Figure 10:
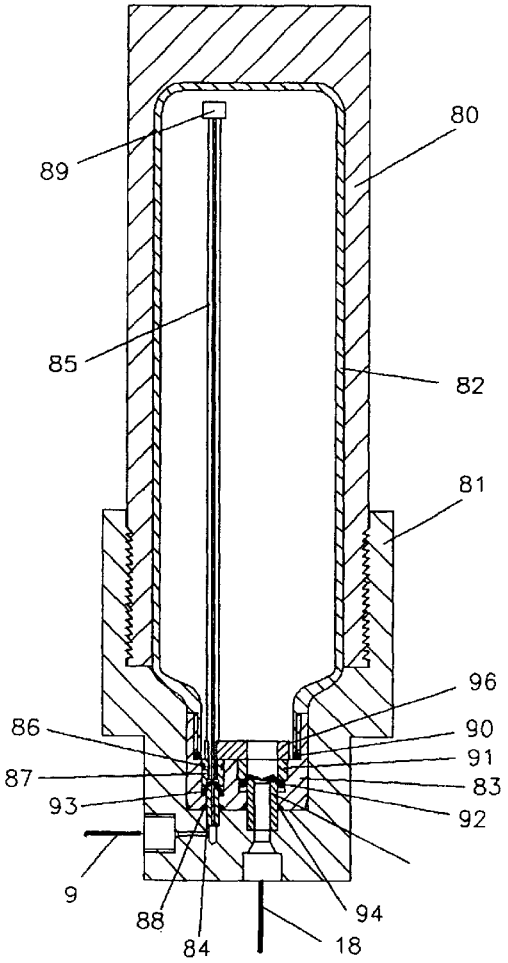
FIG. 10 shows a cross section of a storage vessel for abrasive particles which includes a pre-filled container.
Figure 11:
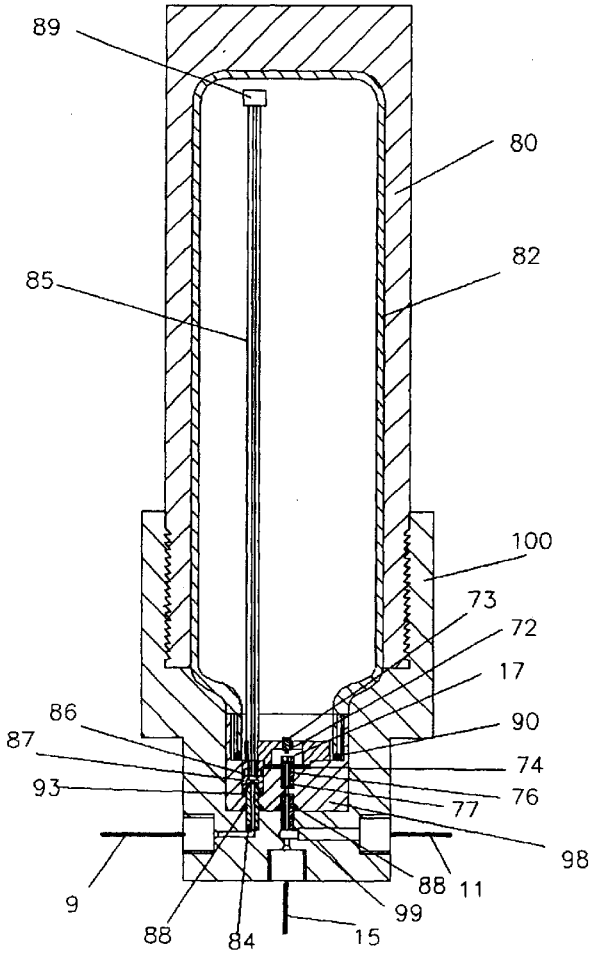
FIG. 11 shows an alternative form of storage vessel.

The apparatus in FIG. 1 is particularly suited to feeding fine jets of less than 100 $\mu$m (microns) diameter. The maximum diameter of abrasive particles needs to be limited to about 60 percent of the nozzle diameter in order to avoid blocking nozzles. Small particles take a relatively long time to settle out of the carrier fluid when vessel 19 is refilled with abrasive through connection 25, making it desirable to load fine abrasive into vessel 19 in a pre-filled cartridge. Using pre-filled cartridges also prevents the abrasive from becoming contaminated with material that could block the nozzle 16. FIGS. 10 and 11 show adaptations of the apparatus of FIG. 1 for the loading of cartridges of pre-graded abrasive into an abrasive storage vessel 19. For nozzle diameters under 100 $\mu$m (microns), the capacity of abrasive storage vessel is typically less than 1 liter for 1 hour of cutting operations. The barrels of abrasive storage vessels of this capacity can be manhandled to allow changing of cartridges containing abrasive and carrier fluid.

The arrangement shown in FIG. 10 is used when an abrasive and water isolation valve of FIG. 6 is included in the apparatus at junction 14 of FIG. 1. A cartridge 82 made of a polymeric material, such as high density polyethylene, and having an external shape matched to the internal shape of vessel 19, is installed in vessel 19. Vessel 19 has a barrel 80 and base 81 that screw together or, preferably, have an interrupted quick release thread to allow rapid inspection of the contents of a cartridge and for changing cartridges. The cartridge 82 has a screw cap 83 that contains passageways which mate with passageways in the base 81 for connection to conduits 9 and 18. The cartridge 82 and cap 83 have a seal 90 located to allow the internal pressure in the cartridge to act on the threaded portion of the cartridge to distort it into the cap threads to provide additional sealing. The cartridge 82 distorts at the join between the barrel 80 and the base 81 to seal the gap between the barrel 80 and the base 81. Seals 88 and 94 seal the connections between the base and the cap.

Carrier fluid entering the base through conduit 9 passes through connector 84, diaphragm seal 93, tube 85 to filter 89, where it discharges into cartridge 82. Carrier fluid and abrasive passes out of the cartridge 82 through plate 96, spacer 91, diaphragm seal 92, connector 94 and a passageway in the base to conduit 18, or into the abrasive/carrier fluid isolation valve of FIG. 6, when the valve is mounted directly on the bottom of the base 81. Tube 85 is retained on plate 96 by retainer 87, which also helps to locate diaphragm seal 93. Retainer 87 is sealed by O ring seal 86.

Filter 89 prevents abrasive particles from entering tube 85 during depressurisation of abrasive storage vessel 19, and when the flow is reversed in the abrasive storage vessel flow circuit to turn off abrasive flow to the nozzle. The filter also stops abrasive entering tube 85 when the cap 83 is fitted to the cartridge 82.

The diaphragm seals 92 and 93 have small knife cuts in the diaphragms that do not open under static conditions when the cartridge is handled during fitting and removal from the base 81, but are opened by connections 94 and 95 in conjunction with the pressure differentials caused by flows into and out of the cartridge 82.

When an abrasive cartridge 82 is used with the abrasive isolation assembly of FIG. 9, the assembly can be incorporated into the abrasive cartridge cap 98 as shown in FIG. 11. The tube 70 of FIG. 9 is not shown in FIG. 11 for reasons of clarity, but is part of the arrangement shown in FIG. 11. The function of items 80, 82, 84, 85, 86, 87, 88, 89, 90 and 93 are the same as for FIG. 10, as is the flow path for carrier fluid entering the abrasive storage vessel from conduit 9. The function of items 17, 72, 74, 75 and 76 are the same as in FIG. 11. The base 100 has an additional passage to that of base 81 in FIG. 10 that connects to conduit 11. Carrier fluid entering from conduit 11 flows through a passage in the base 100 to an annular space between tube 70 and a connector 99, then through a passageway in the cap 98 to piston 76. The remaining flow paths and the operating modes are the same as for the assembly in FIG. 9.

The sealing under static conditions of the flow passage in restrictor 17 by seat 72 prevents abrasive particles and carrier fluid leaking from the cartridge via restrictor 17 during loading and unloading the cartridge from the base 100.

Figure 12:
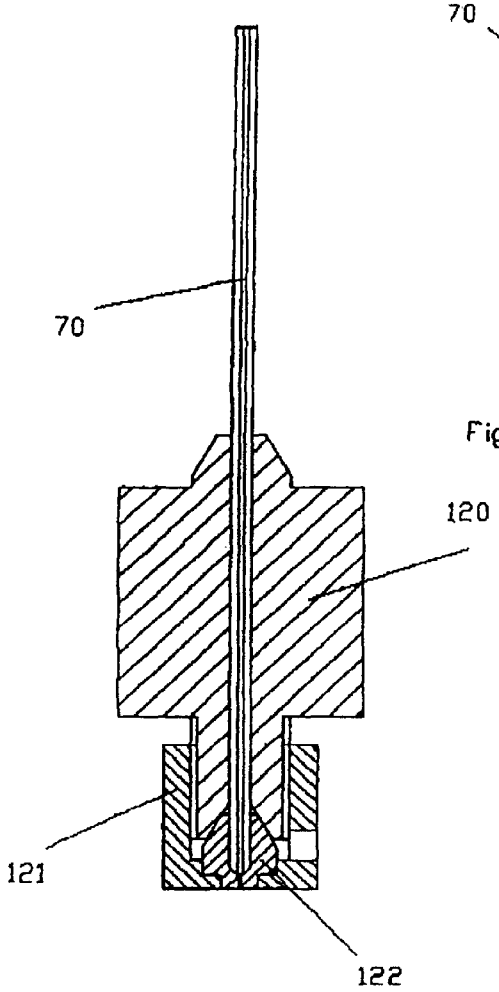
FIG. 12 shows a ceramic nozzle for the container of FIG. 11.

To achieve a clean cut off of abrasive at the nozzle 16 when abrasive is turned off, it is essential that abrasive particles are carried directly from restrictor 17 to nozzle 16 without entering recirculation or stagnant regions in the flow passages. This is particularly important when the abrasive flow to the nozzle is being turned on and off many times per second in synchronisation with movements of the nozzle 16 over a workpiece. FIG. 12 shows a ceramic nozzle 122 retained by nozzle cap 121 and mounted on retainer 120 that screws into the base 100 of vessel 19 in FIG. 11. The inlet end of tube 70 is positioned as for FIG. 9. The outside of the tube 70 is sealed to retainer 120. The nozzle end of tube 70 fits into nozzle 122 so as to leave no dead flow regions. Nozzle 122 is sealed to retainer 120 by a metal to ceramic conical seat.

Figure 13:
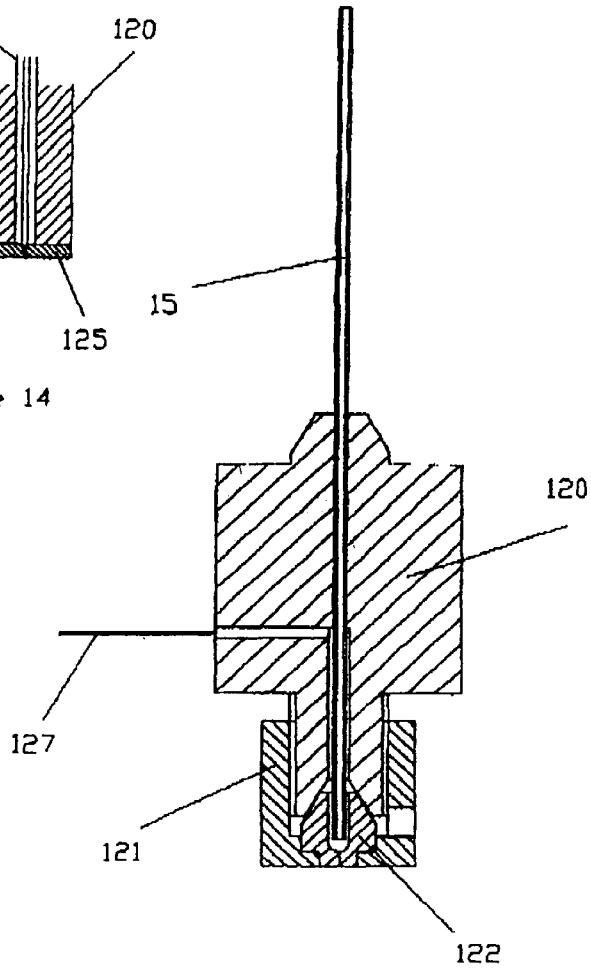
FIG. 13 shows an arrangement for flushing abrasive from the third conduit.

Abrasive particles may settle in the nozzle inlet, particularly when the apparatus is stopped under upset conditions. FIG. 13 shows an arrangement for flushing abrasive from the nozzle 122 and conduit 15 by a flow of carrier fluid from conduit 127 to an annular flow passage between nozzle retainer 120 and conduit 15. At the end of the annular flow passage is an annular gap between the tube forming conduit 15 and the flow passage within the nozzle 122. A flow of carrier fluid to conduit 127 at a pressure in excess of that at conduit 1 in FIG. 1 can be used to stop the flow of abrasive through nozzle 122.

Figure 14:
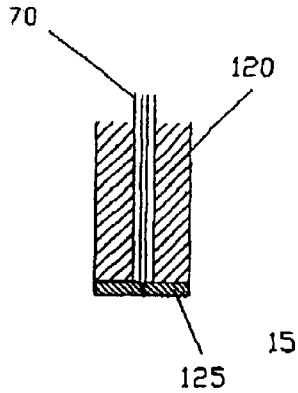
FIG. 14 shows a scrap view of a nozzle for the apparatus.

If the nozzle is machined from sheet or flat blanks of diamond, artificial ruby or sapphire, ceramic or other hard wearing material, the tube 70 can butt up against and be sealed to a nozzle attached to carrier 120, as shown in FIG. 14. This arrangement minimises the area over which pressurised fluid acts and hence the fluid loading onto the nozzle 125. With this arrangement, loads per unit area on the joint between the nozzle 125 and 120 can be maintained within the tension load capabilities of adhesive joints.

Figure 15:
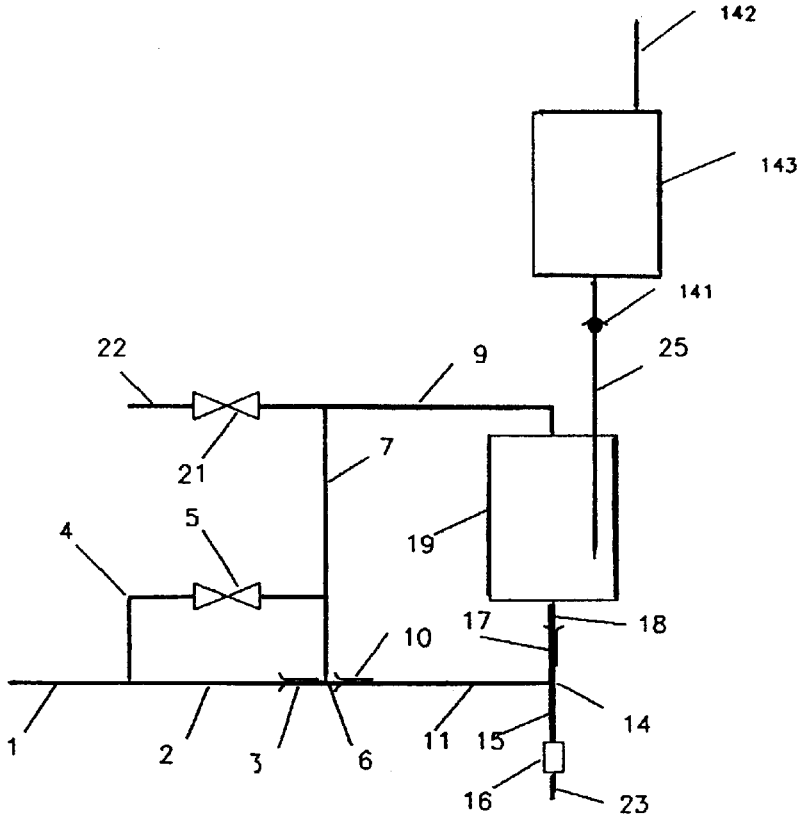
FIG. 15 is a flow diagram of an apparatus including a refill vessel.

An alternative to loading a cartridge of abrasive into abrasive storage vessel 19 is to load cartridges of abrasive into a refill vessel connected to abrasive storage vessel 19. The refill vessel can also be filled from an external source of graded abrasive. Referring to FIG. 15, vessel 143 is connected to a conduit 25 that contains a non-return valve 141 or other isolating valve. A pressurising fluid is applied to conduit 142 to displace abrasive and carrier fluid from refill vessel 143 through conduit 25 into abrasive storage vessel 19. If refilling of vessel 19 is carried out with the apparatus unpressurised, carrier fluid displaced from abrasive storage vessel 19 is discharged along conduit 9, through valve 21 and conduit 22. If refilling of abrasive storage vessel 19 is carried out with the apparatus pressurised transfer of abrasive and carrier fluid from the refill vessel 143 needs to be synchronised with abrasive on/off operations. The maximum transfer rate that can be used is when abrasive is on, corresponding to no jet pump action at junction 6.

When abrasive is selected off the transfer rate from the refill vessel 143 must not be too high or it will weaken the jet pump action at junction 6 to the point where abrasive begins to be discharged through conduit 18.

Figure 16:
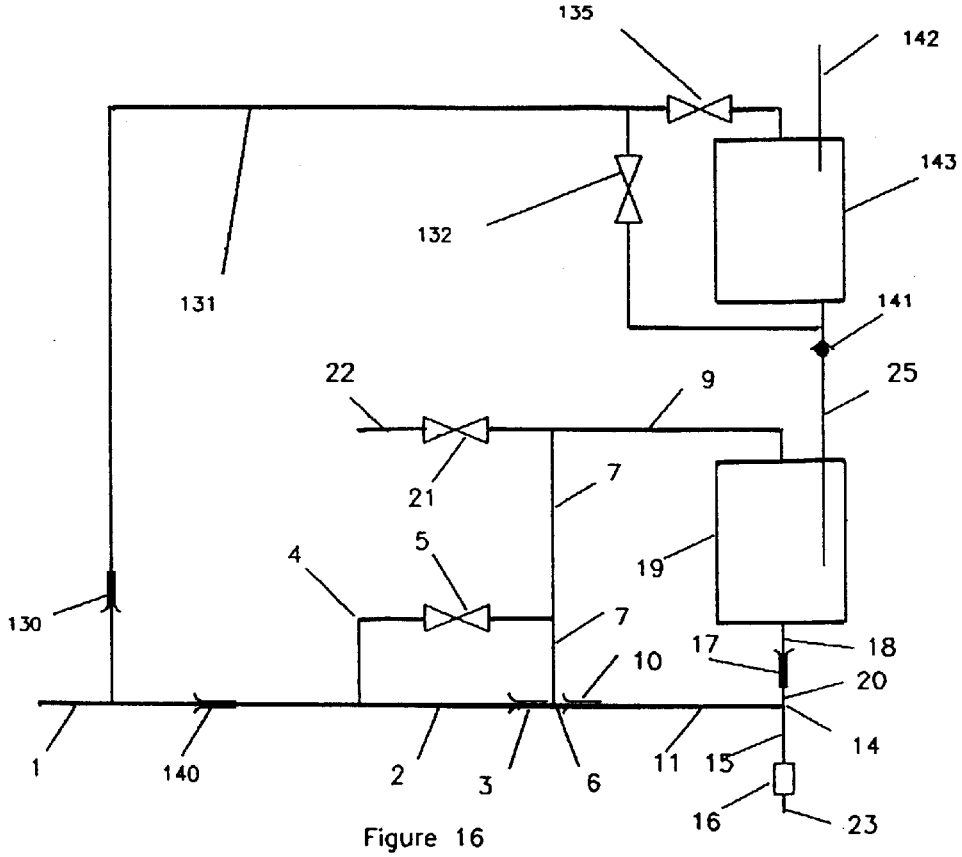
FIG. 16 is a flow diagram of an alternative version of apparatus including a separate refill vessel.

Transfer of abrasive from refill vessel 143 to abrasive storage vessel 19 can be carried out using the arrangement shown in FIG. 16. With valves 132 and 135 closed, the flow circuits of FIG. 16 operate as the circuits of FIG. 1 except for an additional pressure drop across restrictor 140 in conduit 1. With either valve 132 or 135 open, or both valves open, the flow of carrier fluid in conduit 1 divides with part of the flow passing through restrictor 140 in conduit 1 and part through restrictor 130 in conduit 131. With valve 132 closed and 135 open, transfer of abrasive from the refill vessel 143 to the abrasive storage vessel 19 takes place. Closing valve 135, and briefly opening valve 132, clears abrasive from valve 141 prior to depressurising the refill vessel 143.

Conduit 25 in FIGS. 15 and 16 may extend into vessel 19 to maintain a clear layer of carrier fluid in the top of vessel 19, thereby minimising the amount of abrasive particles carried out of the vessel into conduit 9. A filter fulfilling the function of filter 89 of FIGS. 10 and 11 can be fitted to the end of conduit 9. The termination of conduit 25 in abrasive storage vessel 19 can include devices to spread the abrasive and carrier fluid, so that the abrasive rapidly settles in vessel 19. Capacitance or other sensing devices can be included in vessels 19 and 120 to monitor abrasive content.

When the apparatus is used for micro machining, the flow of pressurised carrier fluid into conduit 1 of FIG. 1 is ideally provided by two phased plunger pumps. The plunger pumps described herein have specific advantages when integrated into micro abrasive water jet apparatuses.

Figure 17:
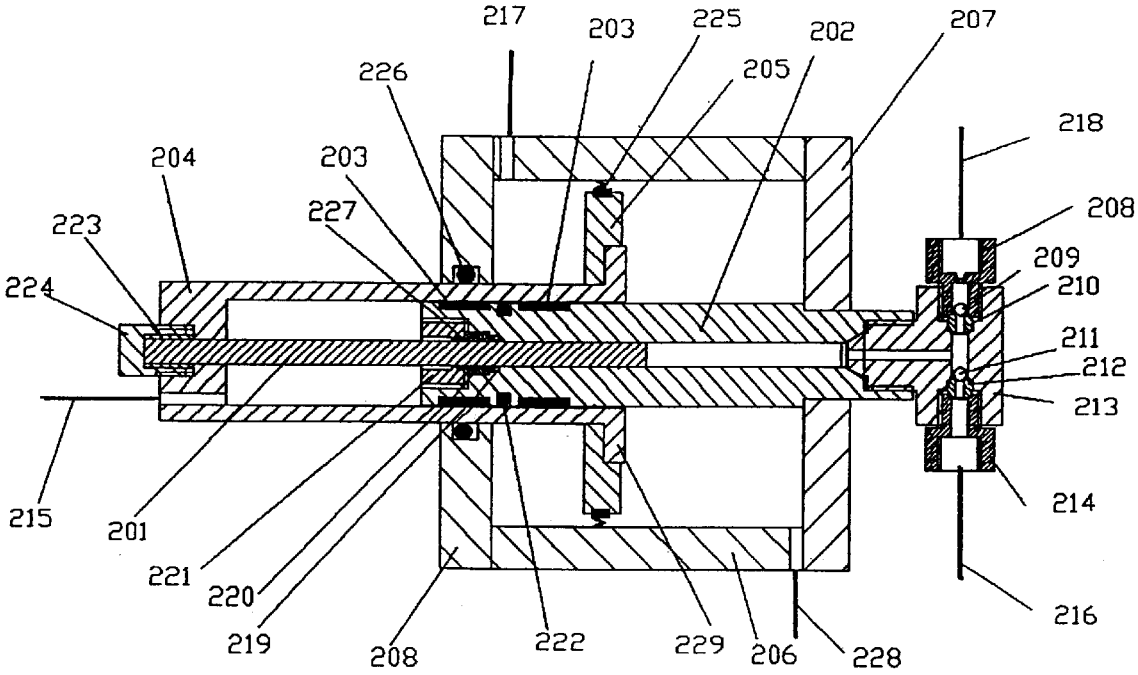
FIG. 17 is a diagram of an intensifier pump to power the apparatus.

Referring to FIG. 17, plunger 201 reciprocates within a pump body 202 which carries bearings 203 on which a reciprocating cylinder 204 moves. Plunger 201 is retained and driven by cylinder 204. Mounted on cylinder 204 is a piston 205 which moves within a fixed cylinder 206 that has end plates 207 and 208. End plate 207 caries the thrust load from the pump body 202 and locates the pump body co-axially within fixed cylinder 206. The reciprocating cylinder 204 extends through end plate 208. A non-return valve assembly, items 208 to 214 is connected to the pump body 202 or located remotely and connected to the pump body 202 by a conduit.

Driving fluid applied to conduit 215 causes the reciprocating cylinder 204 carrying plunger 201 to retract closing the outlet non-return valve 209 and drawing in fluid through the inlet non-return valve 212 from conduit 216. Driving fluid applied to conduit 217 causes the piston 205 and reciprocating cylinder 204 to drive the plunger 201 closing the inlet non-return valve 212 and opening the outlet non-return valve 209 to deliver pressurised fluid into conduit 218.

Seal 219 in pump body 202 isolates the pressurised fluid from the driving fluid. Seal 219 is retained by bush 220, which is also a guide for the plunger 201. Bush 220 is retained by retainer 221. A finite leakage of pressurised fluid through seal 210 can be desirable to lubricate the seal. When contamination of the driving fluid by the pressurised fluid or leakage of driving fluid into the pressurised fluid must be minimised, an additional seal 227 can be used and the space between seals 219 and 227 vented.

Seals 225 and 226 seal the driving fluid from the ambient environment. Seals 225 and 226 are preferably lip seals that can accommodate displacement of the reciprocating cylinder 204 and pump body 202 from the centreline of the fixed cylinder 206 without imposing significant side loads to the reciprocating cylinder 204. This allows substantial tolerances in locating the pump body 202 within the fixed cylinder 206.

Seal 222 isolates the reciprocating cylinder driving fluid from the space between the piston 205 and the fixed cylinder end plate 207.

The preferred arrangement for plunger 201 is a highly polished rod of metal or ceramic material that has a collar 223 attached by adhesive or other well known means. The collar 223 transmits the load from reciprocating cylinder 204 to the plunger 201 during the retraction stroke. Retainer 224 transmits the load from reciprocating cylinder 204 to the plunger 201 during the power stroke. Retainer 224 allows the plunger 201 to be inserted and withdrawn without disassembling other components.

The preferred arrangement is for piston 205 to be held against flange 229 by the driving fluid during the power stroke and by friction forces between seal 225 and the fixed cylinder 206 during the retraction stroke. The preferred arrangement allows conventional pneumatic cylinder pistons with their proprietary piston assemblies, including seals, and a magnet for position sensing, to be used by boring out the piston to slide onto the reciprocating cylinder 204. An alternative is to make piston 205 as an integral part of reciprocating cylinder 204 or to attach it to reciprocating cylinder 204 using well established techniques The non-retum valve assembly, items 208 to 214, is based on well known principles. The inlet connection 214 for fluid entering the pump from conduit 216 screws into body 213 and seals on seat 212, which seals on body 213. Inlet non-return ball 211 seals on seat 212 during the pump delivery stroke. Outlet ball 219 seats on seat 210 during the pump return stroke. Seat 210 is retained by connection 208, connected to delivery conduit 218. The arrangement of the non-return valves, items 208 to 214, involves the minimum number of items to achieve functionality and uses metal to metal contact between components to provide highly reliable sealing. Other well known arrangements for non-return valves could be used in place of the arrangement shown in FIG. 17.

The intensifier pump can be arranged to have a spring between reciprocating cylinder 204 and fixed cylinder end plate 207 to return reciprocating cylinder 204 and plunger 201 after a power stroke. Another arrangement has driving fluid applied through conduit 228 to return the reciprocating cylinder 204 and plunger 201 for a new delivery stroke.

An example of the implementation of the invention to power a 50 $\mu$m (micron) nozzle is a two-phased pneumatically driven intensifier pump delivering about 2 liters per hour of water at 700 bar, with a pressure ripple less than 5 percent. A suitable pump plunger diameter is 6 millimeters, plunger stroke length 45 millimeters, reciprocating cylinder inner diameter 24 millimeters, outer diameter of 32 millimeters and fixed cylinder bore 80 millimeters. The steady state operating air pressure would be about 5.5 bars and the strolling frequency about 15 strokes per minute for each pump. An appropriate size for the abrasive storage vessel is 50 mm internal diameter that takes a 250 ml volume cartridge. The abrasive contents of the cartridge would provide a cutting time of over 1 hour at an abrasive concentration of 10 percent by weight.

Accordingly, the principles of the present invention provide for:

(1) An apparatus to provide a supply of abrasive particles in carrier fluid to a nozzle for machining purposes, characterised in that the apparatus comprises a storage vessel for abrasive particles, a source of pressurised carrier fluid, first conduit means to convey at least a major proportion of said incoming carrier fluid to a nozzle, second conduit means to connect said source of carrier fluid to an inlet of the storage vessel, third conduit means to connect an outlet of the storage vessel to said nozzle, switching means selectively operable either to allow a minor proportion of said incoming carrier fluid to flow through said second conduit means to said storage vessel, to produce a flow of abrasive particles in carrier fluid in said third conduit means, or alternatively to direct substantially all of said carrier fluid through said first conduit means, said switching means further comprising means to cause reversal of flow in said second and said third conduit means, thereby stopping abrasive particle flow to the nozzle.

(2) An apparatus as described in (1), characterized in that the switching means comprises a valve openable to allow fluid flow through said second conduit means and closable to cause all of the flow to pass through said first conduit means.

(3) An apparatus as described in either (1) or (2), characterized in that the means to cause flow reversal comprises jet pump means so located adjacent said first conduit means that, when all of the carrier fluid is directed through the first conduit means, fluid from said second conduit means is entrained into said first conduit means, thereby initiating flow reversal.

(4) An apparatus as described in (3), characterized in that said switching means comprises deflector means activatable to disrupt the fluid flow through said jet pump means adjacent a point where said first conduit means is connected to said second conduit means.

(5) An apparatus as described in any of (1)–(4), characterized in that valve means are provided to stop reverse flow in said second and third conduit means when said third conduit means is cleared of abrasive particles.

(6) An apparatus as described in any of (1)–(5), characterized in that said storage vessel for abrasive particles is fillable with particles in the absence of pressurised carrier fluid and is connectable to said second and third conduit means (7) An apparatus as described in any of (1)–(6), characterised in that said storage vessel comprises a container of abrasive particles and a housing for said container, said housing comprising such connection means that when said housing is closed, said container is connected to said second and third conduit means.

(8) An apparatus as described in (7), characterized in that said connection means comprises sealing means in said connection means to said second and third conduit means and means to stop reverse flow in said third conduit means.

(9) An apparatus as described in any of (6)–(8), characterized in that a second storage vessel for abrasive particles is fillable in the absence of pressurized carrier fluid and has an outlet openable to allow the contents thereof to be transported to said storage vessel under the pressure of the carrier fluid.

(10) A container of abrasive particles for use with an apparatus as described in any of (6)–(9), characterized in that it comprises initially sealed connector means adapted to connect with said second and third conduit means and openable when connected thereto.

(11) A method of providing a supply of abrasive particles in carrier fluid to a nozzle for machining purposes, the method comprising the steps of providing a storage vessel for abrasive particles, providing a source of pressurized carrier fluid, conveying at least a major proportion of said pressurized carrier fluid to a nozzle, switching the flow of said incoming fluid selectively to allow either a minor proportion of said incoming carrier fluid to flow to said storage vessel, and thence with the inclusion of abrasive particles to said nozzle, or alternatively to direct all of said carrier fluid directly to the nozzle in such a manner that fluid from said second conduit means is entrained thereby to initiate reversal of flow at said storage vessel.

(12) A method of machining a workpiece, comprising directing onto said workpiece a jet of abrasive in carrier fluid issuant from a nozzle supplied by an apparatus as described in any of (1)–(9), characterized in that operation of the switching means from one mode to the other will cause the jet to comprise either carrier fluid alone, or carrier fluid plus abrasive particles, the changeover being substantially instantaneous and complete.

(13) An intensifier pump for use with an apparatus as described in any of (1)–(9), characterized in that the pump comprises a first fixed cylinder, a first piston adapted to be acted on by drive fluid so as to be movable therewithin, a reciprocating second cylinder connected to and movable with said first piston, a second fixed piston cooperable with said reciprocating cylinder, and a pump plunger so carried by a closed end of said reciprocating cylinder as to act along a cylindrical bore within said fixed piston to provide a source of pressurization for said carrier fluid when said first piston is acted upon by drive fluid.

(14) An intensifier pump as described in (13), characterized in that driving fluid is supplied alternately to said first cylinder and first piston and to said reciprocating second cylinder and second fixed piston.

What is claimed is:

1. An apparatus for providing a supply of abrasive particles in carrier fluid to a nozzle for machining purposes, the said apparatus comprising:

a storage vessel for abrasive particles;

a source of pressurised carrier fluid;

first conduit means to convey at least a major proportion of said incoming carrier fluid to a nozzle;

second conduit means to connect said source of carrier fluid to an inlet of the storage vessel;

third conduit means to connect an outlet of the storage vessel to said nozzle;

switching means selectively operable in a first position to allow a minor proportion of said incoming carrier fluid to flow through said second conduit means to said storage vessel, to produce a flow of abrasive particles in carrier fluid in said third conduit means, and in second position to direct substantially all of said carrier fluid through said first conduit means; and said switching means further comprising means to cause reversal of flow in said second and said third conduit means, thereby stopping abrasive particle flow to the nozzle.

2. The apparatus of claim 1 wherein said switching means comprises a valve openable to allow fluid flow through said second conduit means and closable to cause all of the flow to pass through said first conduit means.

3. The apparatus of claim 1 wherein said means to cause flow reversal comprises jet pump means so located adjacent said first conduit means that, when all of the carrier fluid is directed through the first conduit means, fluid from said second conduit means is entrained into said first conduit means, thereby initiating flow reversal.

4. The apparatus of claim 3 wherein said switching means comprises deflector means activatable to disrupt the fluid flow through said jet pump means adjacent a point where said first conduit means is connected to said second conduit means.

5. The apparatus of claim 1 further comprising valve means to stop reverse flow in said second and third conduit means when said third conduit means is cleared of abrasive particles.

6. The apparatus of claim 1 wherein said storage vessel for abrasive particles is fillable with particles in the absence of pressurised carrier fluid and is connectable to said second and third conduit means.

7. The apparatus of claim 6 further comprising a second storage vessel for abrasive particles fillable in the absence of pressurized carrier fluid and having an outlet openable to allow the contents thereof to be transported to said storage vessel under the pressure of the carrier fluid.

8. The apparatus of claim 1 wherein said storage vessel comprises a container of abrasive particles and a housing for said container, said housing comprising connection means that when said housing is closed, said container is connected to said second and third conduit means.

9. The apparatus of claim 8 wherein said connection means comprises sealing means in said connection means to said second and third conduit means and means to stop reverse flow in said third conduit means.

10. A container of abrasive particles for use with an apparatus for providing a supply of abrasive particles in a carrier fluid to a nozzle for machinery purposes, said container comprising sealed connector means adapted to connect to an apparatus of claim 1 with said second and third conduit means and openable when connected thereto.

11. An intensifier pump for use with an apparatus for providing a supply of abrasive particles in a carrier fluid to a nozzle for machinery purposes, said pump comprising a first fixed cylinder, a first piston adapted to be acted on by drive fluid so as to be movable therewithin, a reciprocating second cylinder connected to and movable with said first piston, a second fixed piston cooperable with said reciprocating cylinder, and a pump plunger so carried by a closed end of said reciprocating cylinder as to act along a cylindrical bore within said fixed piston to provide a source of pressurization for a carrier fluid in an apparatus of claim 1 when said first piston is acted upon by drive fluid.

12. The intensifier pump of claim 11, wherein driving fluid is supplied to at least one of said first cylinder and first piston and to said reciprocating second cylinder and second fixed piston.

13. A method for providing a supply of abrasive particles in carrier fluid to a nozzle for machining purposes, said method comprising the steps of:

providing a storage vessel for abrasive particles;

providing a source of pressurized carrier fluid;

conveying at least a major proportion of said pressurized carrier fluid to a nozzle; and switching the flow of said incoming fluid selectively to allow a minor proportion of said incoming carrier fluid to flow to said storage vessel, and thence with the inclusion of abrasive particles to said nozzle, and to direct all of said carrier fluid directly to the nozzle in such a manner that fluid from said second conduit means is entrained thereby to initiate reversal of flow at said storage vessel.

14. A method for machining a workpiece, said method comprising the steps of:

directing onto said workplace a jet of abrasive in carrier fluid issuant from a nozzle supplied by an apparatus of claim 1, wherein operation of the switching means from one mode to the other will cause the jet to comprise at least one of carrier fluid alone and carrier fluid plus abrasive particles, the changeover being substantially instantaneous and complete.

* * * * *